United States Patent [19]

Baldwin

[11] 4,160,615

[45] Jul. 10, 1979

[54] CABLE ROCK ANCHOR

[75] Inventor: Stanley L. Baldwin, Winnipeg, Canada

[73] Assignee: The International Nickel Company, Inc., New York, N.Y.

[21] Appl. No.: 889,191

[22] Filed: Mar. 23, 1978

[51] Int. Cl.[2] ..... E21D 21/00

[52] U.S. Cl. ..... 405/259; 52/155

[58] Field of Search ..... 61/45 B; 52/29, 155; 85/88; 405/259

[56] References Cited

FOREIGN PATENT DOCUMENTS 1104471 4/1961 Fed. Rep. of Germany ..... 61/45 B 1152258 9/1957 France ..... 61/45 B

*Primary Examiner*—Jacob Shapiro

*Attorney, Agent, or Firm*—Ewan C. MacQueen; Raymond J. Kenny

[57] ABSTRACT

Directed to a cable rock anchor device whereby a load-supporting cable having considerable length may be anchored in a hole to provide ceiling or wall support underground comprising cable gripping means for gripping the cable during advance of the cable and device through a hole and expandable hole gripping means in contact therewith whereby tension applied to the cable causes the cable gripping means to grip the cable more tightly and causes expansion of the hole gripping means to grip the hole wall.

7 Claims, 8 Drawing Figures

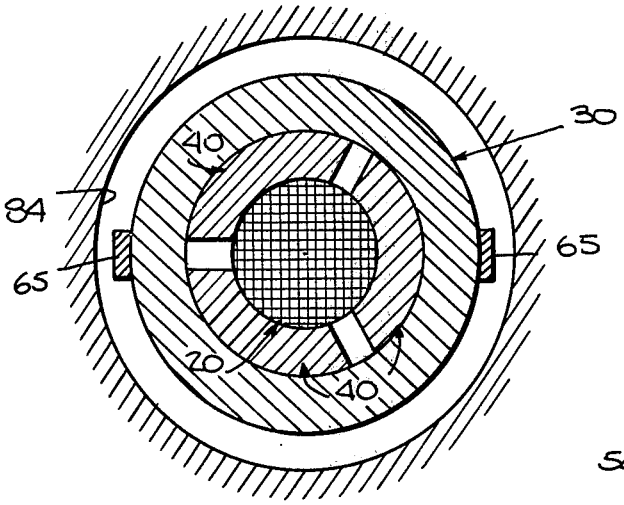
Fig. 7.
Fig. 8.
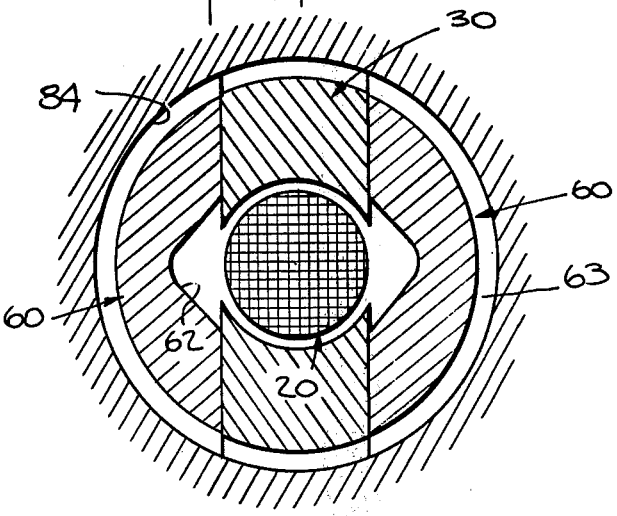
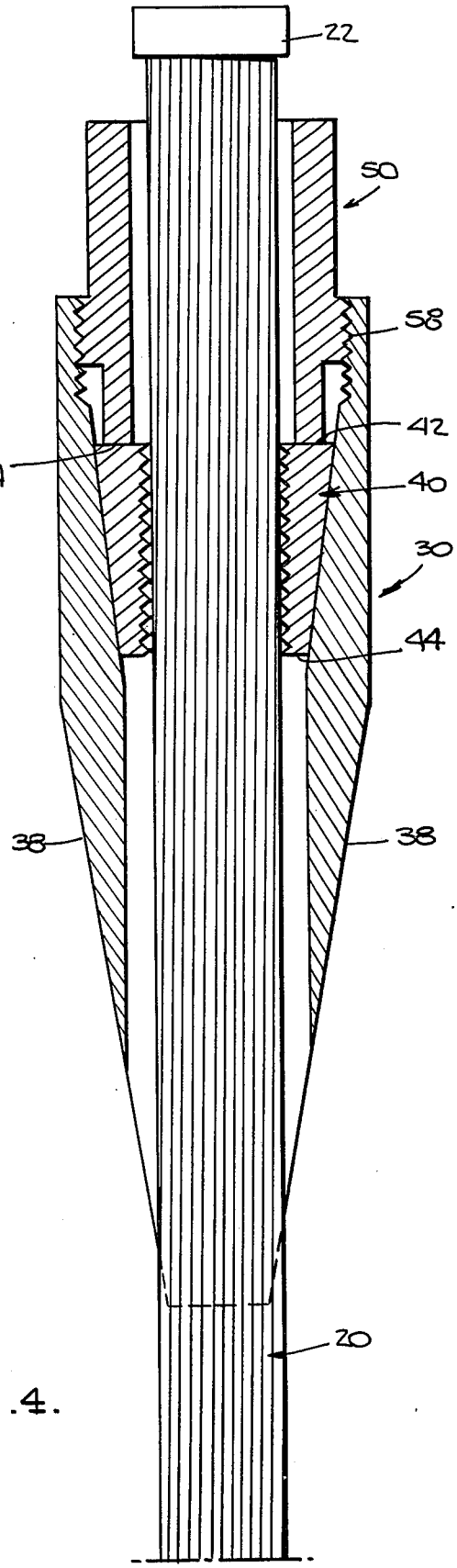
Fig. 4.

Fig. 5.
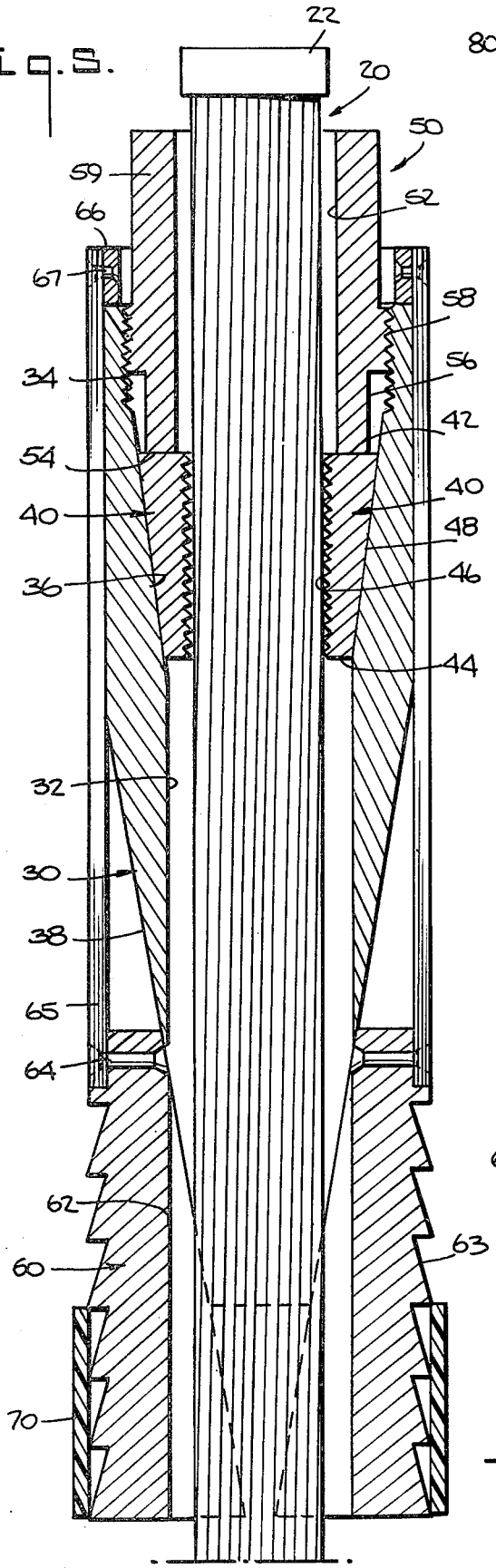
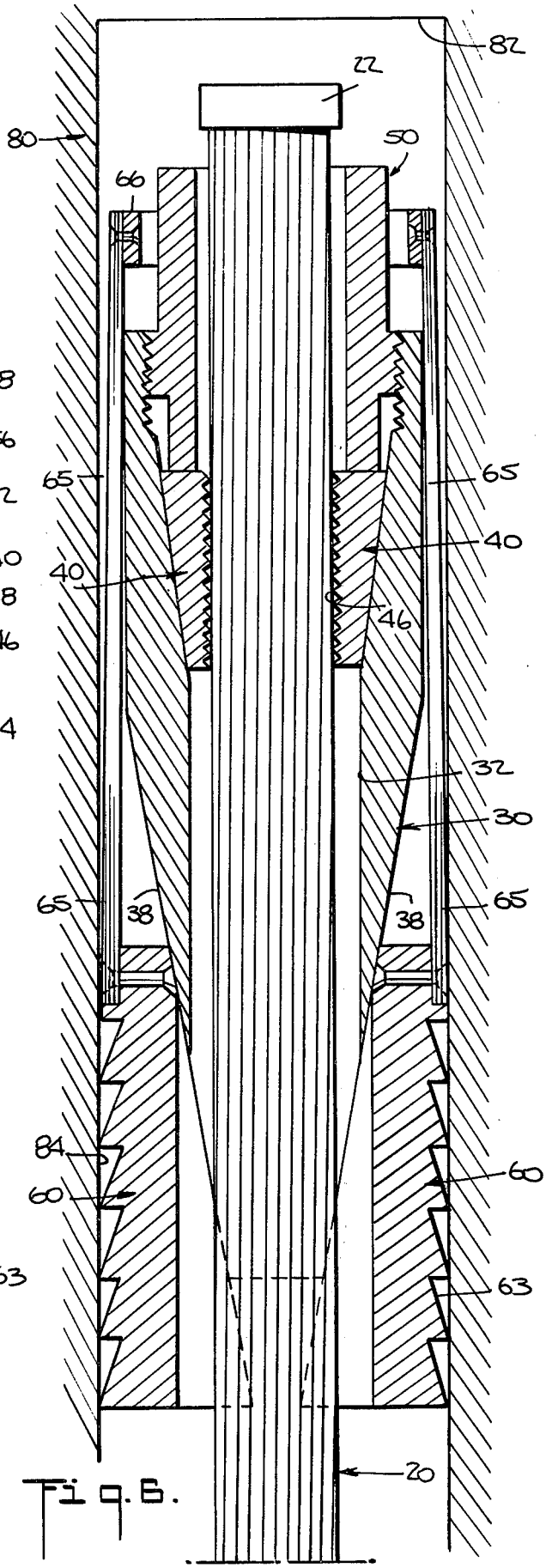
Fig. 6.

CABLE ROCK ANCHOR

The present invention is directed to an expandable device for anchoring cables within drill holes in an ore body.

BACKGROUND

Numerous mechanical devices have been developed for supporting the walls of mine shafts and the ceilings of mine tunnels. Generally, such devices are placed in holes drilled in an ore body and an expansion device actuated to afix the device at the end of the drill hole. This is readily accomplished in a bolt device by tightening a nut against a plate thereby shortening the length of the bolt and expanding a gripping device against the drill hole. Such rock bolts support the ceiling and walls in a mine by absorbing stress that may be generated when cracks develop in the rock layers. Rock bolts are limited in their effectiveness by the length of bolt that can be extended into the drill hole. That is, due to the relative inflexibility of a metal rod, maximum bolt lengths are determined by the height and/or width of the tunnel.

In many instances, it is highly desirable to provide support for mine ceilings by providing an anchorage many meters removed from the tunnel. To illustrate, where an unstable geologic formation is known to exist in the vicinity of the tunnel, an anchorage in solid ground may require the use of cables as long as about thirty meters. Needless to say, rock bolts are of little use in such situations.

In some instances, a flexible cable can be used to secure such unstable ground; however, it is necessary in methods such as those disclosed in U.S. Pat. No. 3,971,226 to extend the cable through drill holes connecting different levels of the mine with conventional cable fastening devices. This solution is not entirely satisfactory, since the distance between mine levels may be well in excess of 100 meters and drilling holes this distance within a mine is not generally economically feasible.

Another method for fastening a cable within a drill hole makes use of an explosive charge to spread the end of a cable at the end of a bore hole (U.S. Pat. No. 3,389,561), followed by filling the hole with grout. Also, along this same line, cables are commonly introduced to the drill hole without any expandable end fitting and the void between cable and drill hole filled with grout. Both of these methods are not entirely satisfactory since they rely on filling of a void space. Since cracks may exist in the geologic structure, the grout may follow a crack in the ore body rather than the void between cable and drill hole. In the event that this occurs, an ineffective anchorage is obtained.

Still another cable anchoring device, described in U.S. Pat. No. 2,970,444, cannot be readily assembled with simple hand tools and in fact is shown to use welding during assembly. Furthermore, the device is explosively actuated within the drill hole and therefore requires special handling and personnel.

SUMMARY OF THE INVENTION

Generally speaking, the present invention is directed to a cable anchoring assembly adapted to anchor a cable in a drill hole in a solid body and can be used, for example, to support an ore body above a mine tunnel. The assembly comprises a cable gripping means advantageously comprising a plurality of segmented frustoconical wedges having toothed cable-engaging faces and having outer faces tapered in the direction of cable loading and providing an essentially 360° bearing face; hollow locking means advantageously comprising a cylinder having an internal bore sufficiently large to clear the cable, an internal frustoconical surface adapted to engage the cable gripping means and having outer wedge shaped planar surfaces tapered in the direction of cable loading; expandable hole gripping means advantageously having outer toothed faces adapted to engage the hole surface into which the assembly is to be engaged and internal planar wedge faces adapted to engage the wedge surfaces on the locking cylinder so as to expand the hole gripping means in response to tension applied to the cable; and means for initially engaging the cable gripping means to the cable surface advantageously comprising a hollow wedge nut adapted to engage the top surfaces of the cable gripping wedges and threadably engaged to the top inner face of the locking cylinder so that the wedge nut drives the cable gripping wedges against the cable face when the nut is screwed into the locking cylinder while the cable gripping wedges are in place therein. The cooperating elements of the assembly hold the assembly in place near the end of the cable during insertion of the cable in the drill hole and serve to grip the cable as the expandable hole surface gripping means engage the hole in response to tension applied to the cable with the grip becoming ever tighter to the cable and to the hole surface as tension on the cable is increased. Screwing the wedge nut into a locking cylinder having an internal conical surface, serves to force segmented conical wedges against a cable, thereby gripping the cable so that the assembly can be pushed into a drill hole. The expandable gripping means, placed in contact with the locking cylinder prior to insertion, is expanded by a wedge shaped planar surface on the locking cylinder so that the expandable gripping means grips the wall of the drill hole when a tensile force is applied to the cable. The cable anchoring device of the present invention can be readily assembled with simple hand tools in close quarters, is not dependent on grout to retain the cable, and does not require explosives to set the device in a drill hole.

BRIEF DESCRIPTION OF THE DRAWINGS

FIG. 4 is a longitudinal cross section of a partially assembled cable anchoring device taken on line 4—4 of FIG. 3.

FIG. 5 is a longitudinal cross section of a completely assembled cable anchoring device prior to insertion in a drill hole.

FIG. 6 is a longitudinal cross section of the cable anchoring device set in a drill hole taken on line 6—6 of FIG. 1.

FIG. 7 is a transverse cross sectional view taken on line 7—7 of FIG. 1.

FIG. 8 is a transverse cross sectional view taken on line 8—8 of FIG. 1.

DESCRIPTION OF THE PREFERRED EMBODIMENTS

Figure 1:
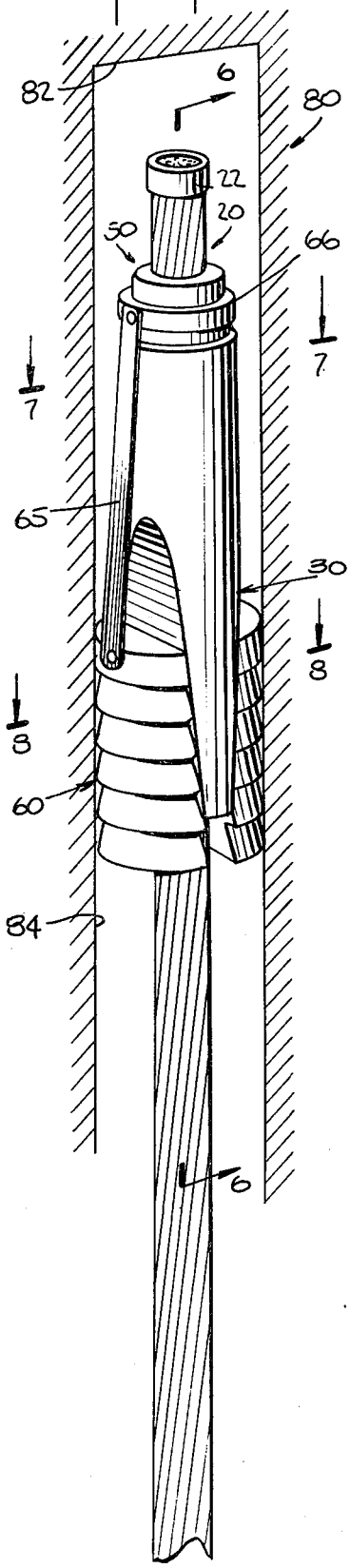
FIG. 1 is a perspective view of an assembled cable anchoring device during use in a drill hole.

Referring now to the drawings, in which like characters of reference indicate corresponding parts in each figure, FIG. 1 shows a perspective view of a cable anchoring device installed in a drill hole 80 after application of a tensile load on the cable 20. The wall 84 of the drill hole is gripped by an expandable gripping means 60 that has been expanded by forward movement of the locking cylinder 30 and the resultant expanding action of the wedge shaped planar outer surface 38. This action is more clearly evident if reference is made to the exploded perspective view of FIG. 2.

Figure 2:
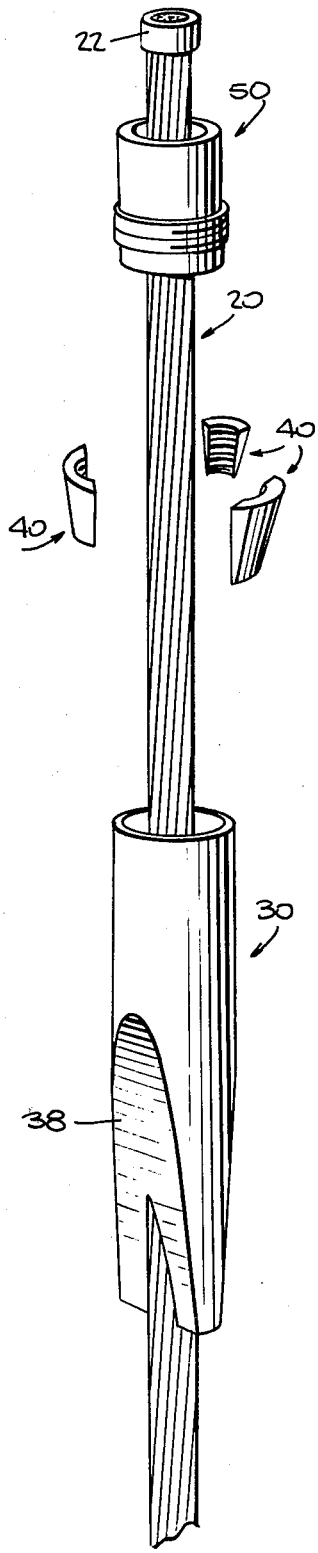
FIG. 2 is an exploded perspective view of a portion of the cable anchoring device Prior to Assembly.

In addition, FIG. 2 shows the positioning of segmented conical wedges 40 which reside within and connect the locking cylinder 30 to the cable 20. The segmented conical wedges 40 are forced against the locking cylinder and the cable 20 by screwing the wedge nut 50 into the locking cylinder 30.

Figure 3:
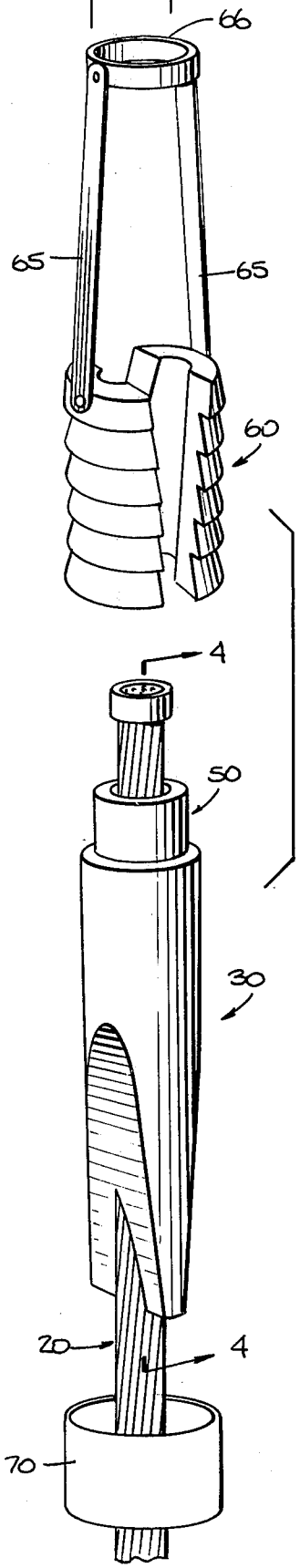
FIG. 3 is an exploded perspective view of a partially assembled cable anchoring device.

FIG. 3 shows an exploded perspective view of the partially assembled cable anchoring device prior to positioning of the expandable gripping means 60. Full assembly is accomplished by sliding the expandable gripping means over the locking cylinder 30 so that the straps 65 rest against, and the cylindrical ring 66 rests atop, the locking cylinder 30. The expandable gripping means is temporarily held in place around the locking cylinder 30 and cable 20 by a bridling means 70 to afford ease of insertion into a drill hole.

A better understanding of the attachment of the locking cylinder 30 to the cable 20 can be obtained by referring to FIG. 4 which shows a longitudinal cross section along line 4—4 of FIG. 3. The raised threaded region 58 of the wedge nut 50 is shown threadably engaged with the locking cylinder 30. The extended bearing surface 54 of the wedge nut 50 bears against the truncated bearing surface 42 of the segmented conical wedges 40 so that these are forced against the locking cylinder 30 and inwardly against the cable 20.

The cross sectional view shown in FIG. 5 represents a cable anchoring assembly ready for insertion within a drill hole. The end of a cable 20, to be inserted within the drill hole, is kept from fraying by attachment of a strand retainer means 22 prior to cutting. A swaged band of metal can be used as a strand retainer means.

The locking cylinder 30, which can be prepared from a plain carbon steel, has a first central bore 32 which is sufficiently large in diameter to fit over the cable and strand retainer means. At the opposite end of the locking cylinder is a threaded second central bore 34 which is connected to the first central bore by a conical surface 36. The angle formed between the conical surface 36 and the axis of the locking cylinder 30 should be from about 4° to about 16°, preferably from about 6° to about 10° and most preferably from about 7° to about 8°. A portion of the locking cylinder has a wedge-shaped planar outer surface 38 which intersects the first central bore 32 at an angle of from about 5° to about 15°, preferably from about 8° to about 12° and most preferably at about 10°.

A plurality of segmented conical wedges 40 are shown adjacent the locking cylinder. Preferably, the wedges 40 are prepared from a hardened steel. The larger end of each wedge has a truncated bearing surface 42. The opposite end of each wedge 44 can be pointed or truncated. Adjacent to the truncated bearing surface 42, on the inner diameter of the wedge, is an inner gripping surface 46 which serves to grip the cable. Preferably, the inner gripping surface 46 can have a grooved pattern resembling screw threads. About 6 pointed surfaces per centimeter having a gripping surface angle of about 90° and a trailing surface angle of about 45° have been found useful for this purpose. Many other patterns (i.e., serrated, diamond, etc.) are considered useful for this purpose and accordingly within the scope of the present invention. Opposite the inner gripping surface 46 and adjacent to the truncated bearing surface 42 is an outer smooth surface 48 which is shown to slideably engage the conical surface 36 of the locking cylinder 30. The angle between the axis of the wedges and the outer smooth surface 48 should be from about 6° to about 18°, preferably from about 8° to about 12° and still more preferably about 10°. In order to obtain a locking action between cable 20 and inner gripping surfaces 46, the angle between the axis of the wedges and the outer smooth surface 48 should be greater than (preferably at least about 2° greater than) the angle formed between the conical surface 36 and the axis of the locking cylinder 30.

A wedge nut 50 having a central passageway 52 to clear the cable 20 and strand retainer means 22 has an extended bearing surface 54 which contacts the truncated bearing surfaces 42 of the plurality of segmented conical wedges 40. The extended bearing surface 54 has an outer diameter selected to clear the threaded second central bore 34 of the locking cylinder 30. The diameter of the extended bearing surface 56 is selected to be sufficiently small to avoid contact with the conical surface 36 of the locking cylinder 30. Also, the diameter of the extended bearing surface 56 is somewhat smaller than the diameter of the truncated bearing surface 42 of the conical wedges 40. The wedge nut 50 has a raised threaded region 58 adjacent to the extended bearing surface which threadably engages the threaded second central bore 34 of the locking cylinder 30. Just beyond the raised threaded region 58 is a wrenching surface 59. The wrenching surface 59 is used to screw the wedge nut 50 into the locking cylinder 30 to engage the extended bearing surface 54 of the wedge nut against the truncated bearing surfaces 42 of the wedges 40. The wedges 40 slide against the conical surface 36 of the locking cylinder 30 and are forced inwardly against the cable 20 thereby locking the assembly consisting of wedge nut 50, wedges 40 and locking cylinder 30 to the cable 20. The wedge nut 50, which can be prepared from a plain carbon steel, can be cylindrical so that it can be tightened with a pipe wrench or it may have flats machined thereon so that it can be tightened with an open-ended or closed-box wrench.

It has been found expedient to tap the end of the cable 20 with a hammer while screwing the wedge nut 50 into the locking cylinder 30. This action helps to align as well to set the segmented conical wedges 40 against the cable 20.

An expandable gripping means 60, which can be prepared from a low alloy steel or cast iron, is fitted over and engages the wedge-shaped outer surface 38 of the locking cylinder 30 along a V-shaped slot 62. The expandable gripping means 60 has an outer gripping surface 63 for engaging the surface of a drill hole. The gripping surface 63 can consist of a series of circumferential, wedge-shaped surfaces. Expandable gripping means similar to that of the present invention are well known, and a suitable device is described as an expansible anchoring shell in U.S. Pat. No. 2,753,750, incorporated herein by reference. The expandable gripping means is attached with fastening means 64, e.g., rivets, welds, etc., to straps 65 which, in turn, are connected to a cylindrical ring 66 with joining means 67, e.g., rivets, welds, etc., and is placed over the wedge nut 50. The cylindrical ring 66 and strap 65 serve to maintain the positioning of the expandable gripping means 60 in close relation to the locking cylinder 30 during insertion of the assembly in a drill hole. A bridling means 70 is used to maintain the expandable gripping means 60 in contact with the wedge shaped outer surface 38 of the locking cylinder 30. A polymeric material such as a piece of polyethylene tubing of appropriate diameter has been found to be useful for this purpose.

FIG. 6 shows a cross sectional view along line 6—6 of FIG. 1 after the anchoring device has been pushed into a drill hole 80 to the end of the hole 82 and subsequently pulled forward. During insertion of the anchoring device into the drill hole 80, the bridling means 70 is generally self-removed due to abrasion with the wall of the drill hole 84. Once the cable 20 has contacted the end of the drill hole 82, the cable 20 is pulled forward which causes the outer gripping surface 63 of the expandable gripping means 60 to engage the walls of the drill hole 84.

During insertion of the assembled device into the drill hole 80, the locking cylinder wedge nut 50 and expandable gripping means 60 are held in place against the cable 20 by the compressive action of the wedge nut 50 against the wedges 40 and locking cylinder 30. Once in place at the end of the drill hole 82, tensile forces applied to the cable 20 are also transmitted through the wedges 40 to the locking cyliner 30, and from there to the expandable gripping means 60 to the wall of the drill hole. Thus, the assembled anchoring device restrains the cable 20 in tension as well as in compression.

FIG. 7 shows a transverse cross sectional view of the assembled anchoring device taken along line 7—7 of FIG. 1. The diameter of the assembly including straps 65 is shown to be smaller than the diameter of the drill hole wall 84. Three segmented conical wedges 40 are shown bearing against the locking cylinder 30 and the cable 20. A further transverse cross section through the expandable gripping means 60 along line 8—8 of FIG. 1 is shown in FIG. 8. The outer gripping surface 63 of the expandable gripping means is shown spread apart by the action of the locking cylinder 30 against the wall 84 of the drill hole.

For the purpose of giving those skilled in the art a better understanding of the invention, the following illustrative example is given:

EXAMPLE

A 6 centimeter diameter by 18.4 cm long locking cylinder was slipped over the end of a 2.54 cm diameter cable and strand retainer with the wedge shaped outer surface of the locking cylinder positioned away from the cable end. The opposite end of the locking cylinder, having the larger threaded central bore, was positioned at a location removed about 8 cm from the end of the cable.

With the axis of the cable in the vertical position, three conical wedges, having a 10° angle between their outer smooth surface and their central axis, were positioned through the threaded central bore of the locking cylinder along the cable to rest in contact with the conical surface of the locking cylinder and the surface of the cable.

A 5.1 cm outside diameter wedge nut having a 4.3 cm outside diameter extended bearing surface was manually turned into the locking cylinder until it contacted the conical wedges. The end of the cable was tapped with a hammer while an ordinary pipe wrench having a 30 cm long handle was used to fully tighten the wedge nut against the conical wedges.

The partially assembled cable anchoring device represented in FIG. 4 was subjected to tensile testing in a Baldwin tensile testing unit. The cable was gripped with conventional tensile testing grips at one end and the partially assembled device restrained by a testing fixture having a plate member with a 3 cm diameter hole. The cable was loaded without failure to a load of 267,000 Newtons (60,000 pounds), representing the proof load for a 2.54 cm (1 inch) diameter cable.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and appended claims.

I claim:

1. An anchor assembly adapted to anchor a cable disposed within a hole comprising, in combination, cable gripping means for gripping said cable while said cable and said anchor assembly are being advanced within said hole, and expandable hole gripping means in contact with said cable gripping means, said cable gripping means comprising a set of conical wedges having toothed faces in contact with said cable and smooth frustoconical outer faces engaging a cooperating smooth frustoconical face communicating with said hole gripping means, said expandable hole gripping means having outer hole-engaging toothed faces and smooth wedge shaped inner faces in contact with smooth wedge faces communicating with said cable gripping means to expand said hole-engaging toothed faces outwards in response to tension applied to said cable, whereby tension applied to said cable causes said cable gripping means to grip said cable ever more tightly and said hole gripping means to engage the face of said hole ever more tightly as said tension is increased.

2. An anchor assembly in accordance with claim 1 wherein said hole gripping means and said cable gripping means are connected by a hollow cylindrical body having wedge faces on the outer surface thereof to expand said hole gripping means and having an inner frustoconical face adapted to engage the outer frustoconical faces of said cable gripping means.

3. An anchor assembly in accordance with claim 2 wherein means are provided to initially engage the toothed faces of said cable gripping means against said cable.

4. A cable anchoring assembly adapted to anchor a cable in a solid body comprising:

(a) a locking cylinder having a first central bore of a diameter sufficient to clear said cable and a threaded second central bore of larger diameter than said first bore, said first bore and said second bore connected by a conical surface and said cylinder having a wedge-shaped outer surface intersecting said first bore;

(b) a plurality of segmented conical wedges having a truncated bearing face adjacent a gripping surface for gripping said cable and a smooth surface for slideably engaging said conical surface of said locking cylinder;

(c) a wedge nut having a central passageway to clear said cable and an extended bearing surface having an outer diameter to clear and partially extend beyond said threaded second central bore without contacting said conical surface of said locking cylinder while bearing against said truncated bearing face of said wedges, said nut having a raised threaded region adjacent said extended bearing surface to threadably engage said threaded second central bore of said locking cylinder, and a wrenching surface adjacent said raised threaded region; and (d) an expandable gripping means having an outer gripping surface and a V-shaped slot to slideably engage said wedge-shaped outer surface of said locking cylinder.

5. A cable anchoring assembly as defined in claim 4 wherein, said conical surface of said locking cylinder forms an angle of from about 4° to about 16° with the axis of said locking cylinder.

6. A cable anchoring assembly as defined in claim 4 wherein, said smooth surface and the axis of said conical wedges form an angle of from about 6° to about 18°.

7. A cable anchoring assembly as defined in claim 6 wherein, said angle formed between said smooth surface and the axis of said conical wedged is at least 2° greater than the angle formed between said conical surface and the axis of said locking surface.

* * * * *